US008449187B2

(12) United States Patent
Nakamura et al.

(10) Patent No.: US 8,449,187 B2
(45) Date of Patent: May 28, 2013

(54) FLUID CONTAINING BAG

(75) Inventors: Toshio Nakamura, Osaka (JP); Tsuneo Nakamura, Osaka (JP)

(73) Assignee: World Water Bag Co., Ltd., Osaka-shi (JP)

( * ) Notice: Subject to any disclaimer, the term of this patent is extended or adjusted under 35 U.S.C. 154(b) by 325 days.

(21) Appl. No.: 12/681,248

(22) PCT Filed: Jul. 23, 2008

(86) PCT No.: PCT/JP2008/063205

§ 371 (c)(1),
(2), (4) Date: Apr. 1, 2010

(87) PCT Pub. No.: WO2009/054171

PCT Pub. Date: Apr. 30, 2009

(65) Prior Publication Data

US 2010/0220942 A1 Sep. 2, 2010

(30) Foreign Application Priority Data

Oct. 24, 2007 (JP) ..... 2007-276821

(51) Int. Cl.
*B65D 33/02* (2006.01)
*B65D 30/00* (2006.01)

(52) U.S. Cl.
USPC ..... 383/119; 383/107; 383/903; 383/906

(58) Field of Classification Search
USPC ..... 383/107, 108, 903, 906, 43, 44, 46, 383/48, 119, 33–35
See application file for complete search history.

(56) References Cited

U.S. PATENT DOCUMENTS

| | | | | | |
|---|---|---|---|---|---|
| 2,294,220 | A * | 8/1942 | Albertson | 53/415 |
| 3,384,294 | A * | 5/1968 | Astle | 383/44 |
| 4,539,236 | A * | 9/1985 | Vilutis | 428/35.2 |
| 5,863,131 | A | 1/1999 | Nakamura | |
| 8,002,468 | B2 * | 8/2011 | Otsuka et al. | 383/104 |

FOREIGN PATENT DOCUMENTS

| | | | |
|---|---|---|---|
| JP | 97/013699 | | 4/1997 |
| JP | 09183442 | A * | 7/1997 |
| JP | 09-226782 | | 9/1997 |
| JP | 09-255001 | | 9/1997 |
| JP | 09-315445 | | 12/1997 |
| JP | 11079195 | A * | 3/1999 |
| JP | 11334748 | A * | 12/1999 |
| JP | 2000142732 | A * | 5/2000 |
| JP | 2000238800 | A * | 9/2000 |
| JP | 2001-097395 | | 4/2001 |
| JP | 2001-104101 | | 4/2001 |
| JP | 2001088847 | A * | 4/2001 |
| JP | 2001315801 | A * | 11/2001 |
| JP | 2001315804 | A * | 11/2001 |
| JP | 2005289418 | A * | 10/2005 |
| JP | 2007223656 | A * | 9/2007 |
| WO | WO 2007089622 | A2 * | 8/2007 |

* cited by examiner

*Primary Examiner* — Jes F Pascua
(74) *Attorney, Agent, or Firm* — Jordan and Hamburg LLP

(57) ABSTRACT

A fluid containing bag according to the invention includes a bag main body which is constituted by front and rear two sheets and an entire periphery of which is hermetically sealed except one portion, an inlet/outlet spout one end side of which is connected to the one portion and other end side of which is extended to outside of the bag main body, means for closing an inlet/outlet port of the inlet/outlet spout, and a reinforcing tape attached to a portion or an entire periphery of an inner peripheral face of the bag main body connecting side base portion of the inlet/outlet spout.

4 Claims, 11 Drawing Sheets

FLUID CONTAINING BAG

BACKGROUND OF THE INVENTION

The present invention relates to a bag, particularly relates to a fluid containing bag preferable for containing and/or carrying a fluid of a liquid, a POWDER, a particle, a gel-like substance, a kneaded substance or the like.

The inventors have developed a bag comprising a bag main body which is constituted by front and rear two sheets and an entire periphery of which is sealed except one portion, an inlet/outlet spout in a shape of a flat cylinder one end side of which is connected to the one portion and other end side of which is extended to outside of the bag main body, and a pocket portion arranged on a front face side of a base portion of the inlet/outlet spout at a vicinity of the bag main body as shown by Patent Reference 1 shown below with an object of preserving drinking water or the like to invent a bag capable of closing an opening portion of the inlet/outlet spout by containing the inlet/outlet spout by folding the inlet/outlet spout in an axial direction to contain in the pocket portion.

Patent Reference 1: JP-A-9-315445

SUMMARY OF THE INVENTION

When a fluid is contained in the above-described bag and the opening portion of the inlet/outlet spout is closed, a problem is not posed at all in a normal situation of using the bag in containing and carrying a fluid. However, when a strong external force is exerted to the bag by dropping or excessive pressing, at the bag side base portion of the inlet/outlet spout, as shown by FIG. 13, an inner pressure (indicated by a slender arrow mark) of expanding the inlet/outlet spout is applied. The inner pressure is concentrated on a portion of adhering two sheets constituting the inlet/outlet spout to constitute a force (indicated by a white bold arrow mark) in a direction of expanding an adhering portion. Further, when the external force is repeatedly exerted, the adhering portion is gradually peeled, depending on cases, there is a concern of leaking water by exfoliating the adhering portion. When a strong press force is exerted actually until destructing the bag of the background art, the adhering portion of the bag side base portion of the inlet/outlet spout is exfoliated to leak water, however, water is not leaked from a portion other than the bag side base portion of the inlet/outlet spout.

It is an object of the invention to provide a fluid containing bag having no concern of leaking water or breaking even under a special situation of using the bag in which a strong external force is repeatedly exerted as described above.

A fluid containing bag according to the invention is characterized by comprising a bag main body which includes front and rear two sheets and an entire periphery of which is hermetically sealed except one portion, an inlet/outlet spout one end side of which is connected to the one portion and other end side of which is extended to outside of the bag main body, means for closing an inlet/outlet port of the inlet/outlet spout, and a reinforcing tape attached to a portion or an entire periphery of an inner peripheral face of a base portion of the inlet/outlet spout on a side of being connected to the bag main body. By constituting in this way, the reinforcing tape achieves a function of preventing the bag main body connecting side base portion of the inlet/outlet spout from being destructed.

Further, in addition to the above-described constitution, there may be constructed a constitution in which the inlet/outlet spout is formed by adhering both side portions of two sheets, and the reinforcing tape is attached to bridge at least the two sheets forming the inlet/outlet spout at both side adhering portions of the inlet/outlet spout.

Further, in addition to the above-described constitution, there may be constructed a constitution in which gaps are present between the both side adhering portions of the inlet/outlet spout and the reinforcing tape.

Furthermore, there may be constructed a constitution in which an inner face side of the inlet/outlet spout and an outer face side constituting an adhering face of the reinforcing tape are constituted by the same material of a melt-press-contacting plastic material, and an inner face side constituting a nonadhering face of the reinforcing tape is constituted by a plastic material having a melting point higher than a melting point of the outer face side of the reinforcing tape.

According to the fluid containing bag of the invention, by the above-described constitution, there is not a concern of leaking water or breaking at all even in being used under a special situation of repeatedly exerting a strong external force.

DETAILED DESCRIPTION OF THE INVENTION

A preferable embodiment of the invention will be explained in details in reference to the attached drawings.

Embodiment

Figure 1:
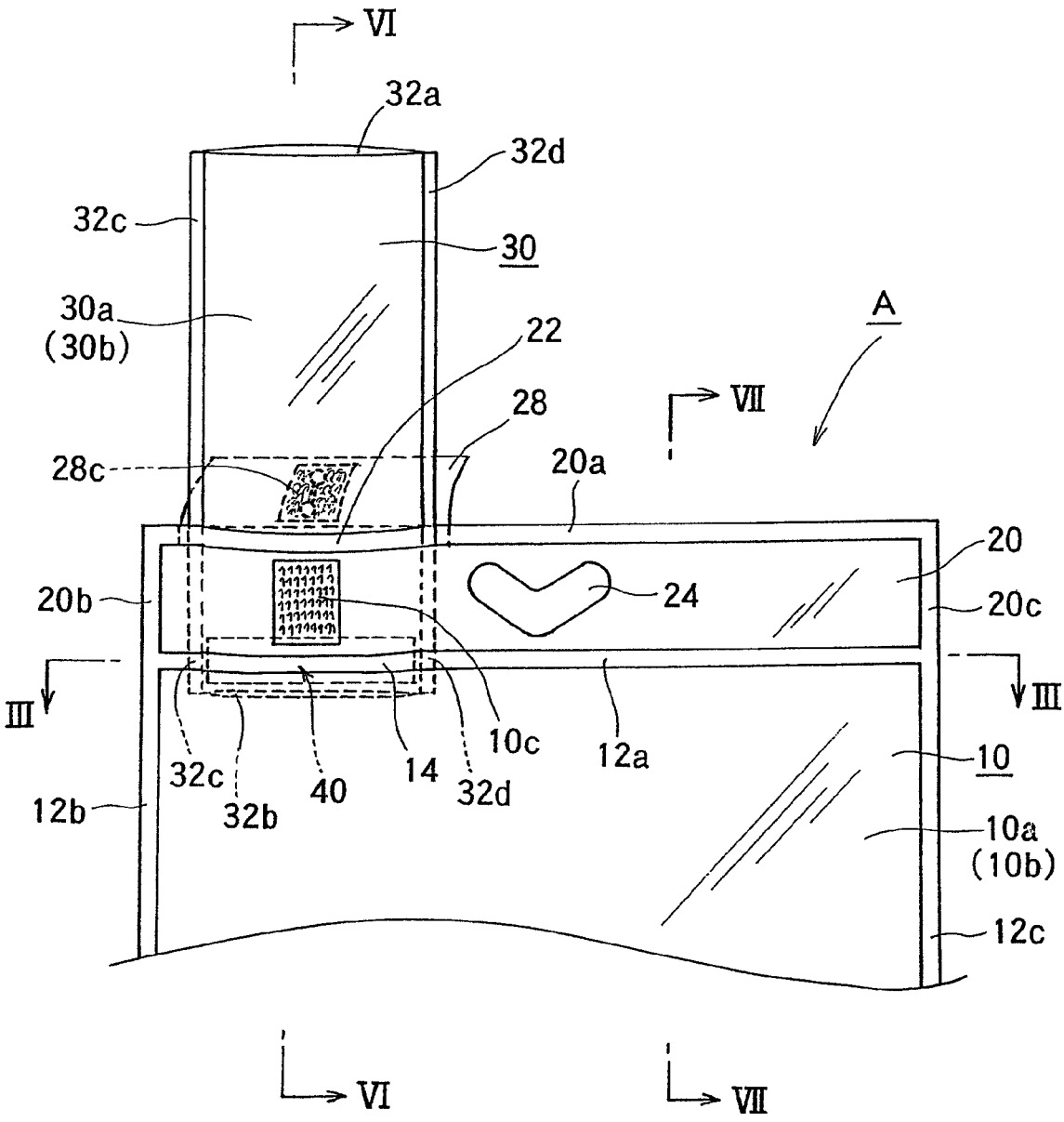
FIG. 1 is a front view showing an upper half portion of a fluid containing bag of an embodiment according to the invention.
Figure 2:
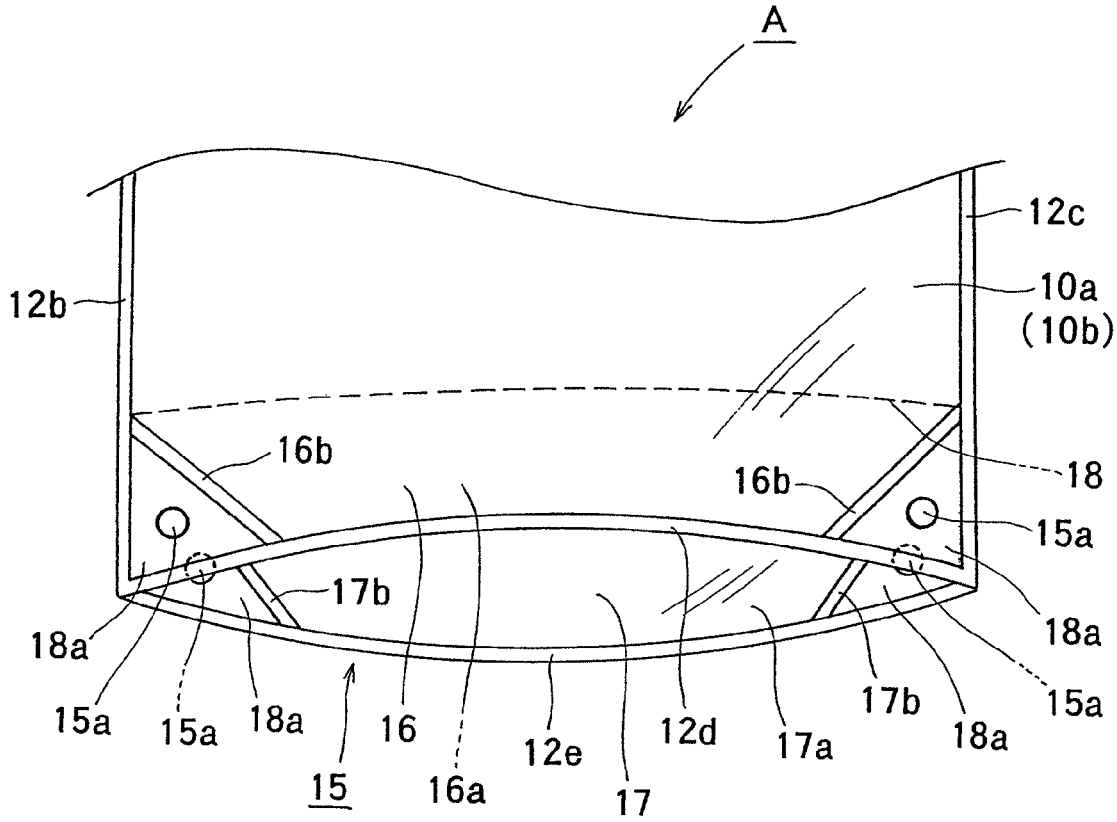
FIG. 2 is a front view showing a lower half portion of the fluid containing bag of the embodiment according to the invention.
Figure 3:
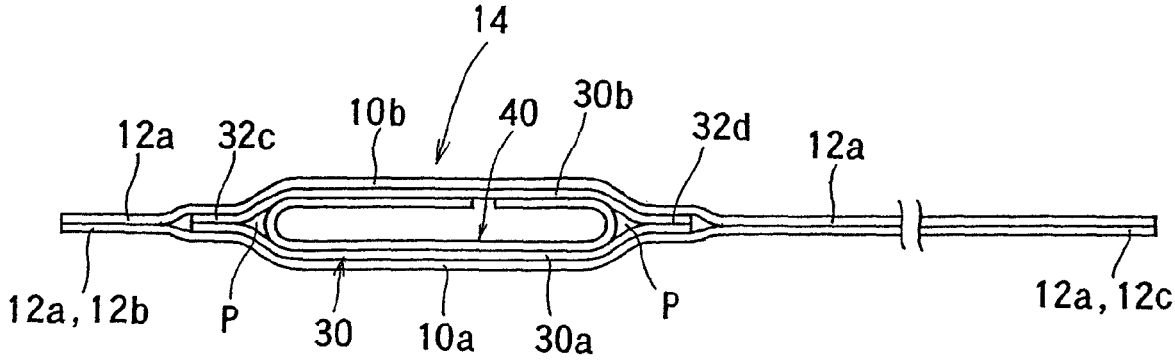
FIG. 3 is a view of an end face taken along a line III-III of FIG. 1.
Figure 4:
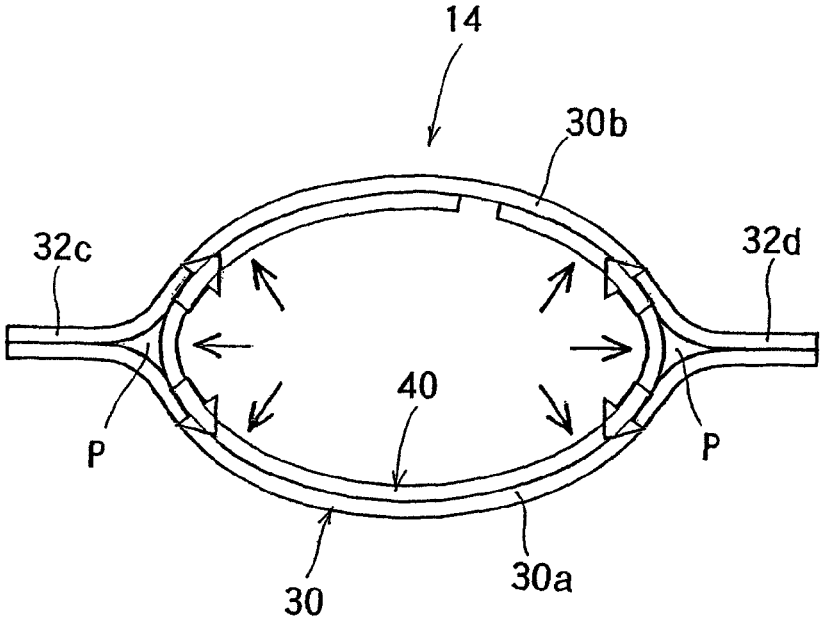
FIG. 4 is a schematic view showing a state of applying a pressure to a reinforcing tape attached to an inner peripheral face of a base portion on a side of being connected to a bag main body of an inlet/outlet spout of the fluid containing bag of the embodiment according to the invention.
Figure 5:
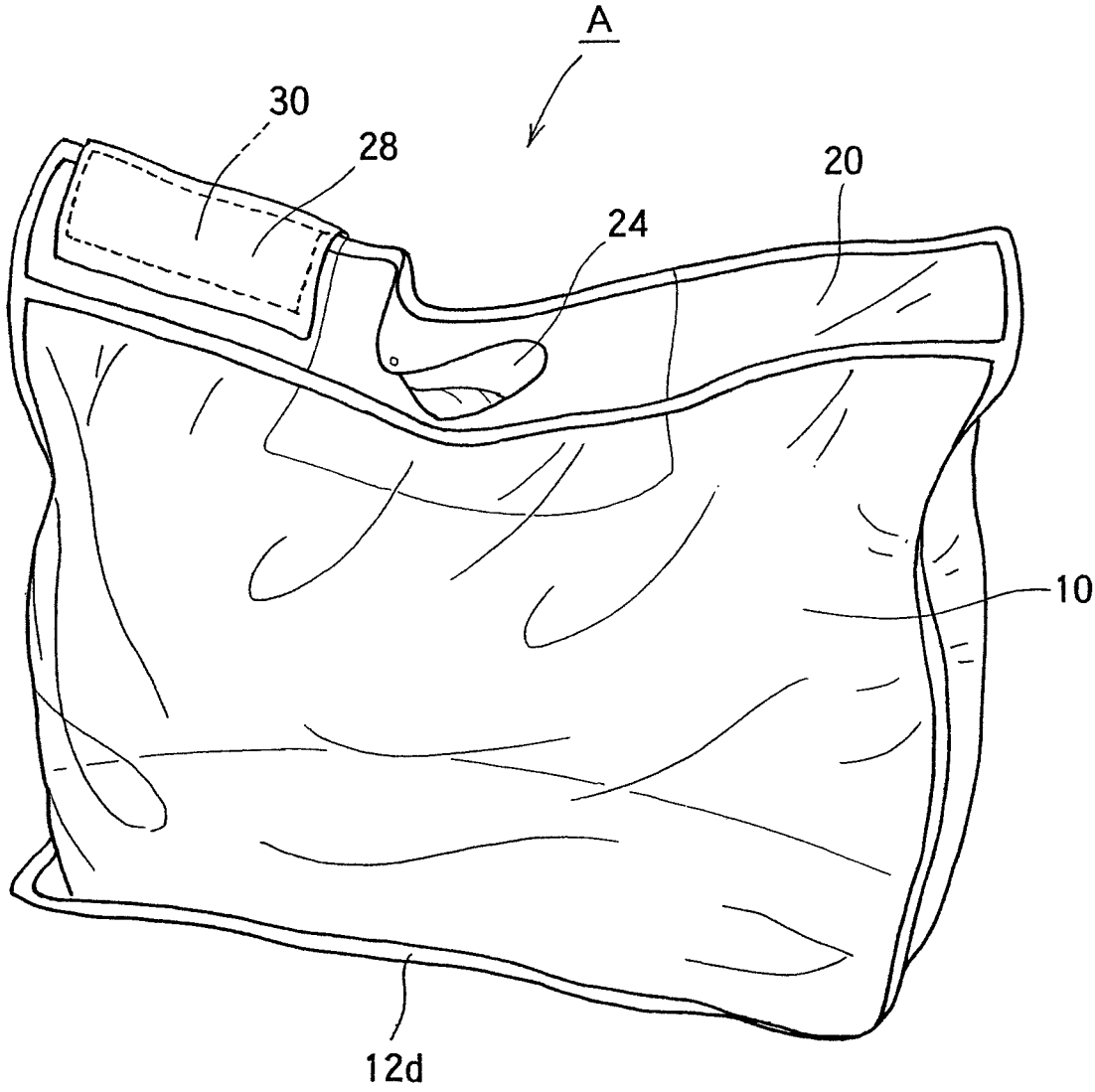
FIG. 5 is a perspective view showing a state of containing water in the fluid containing bag of the embodiment according to the invention.
Figure 6:
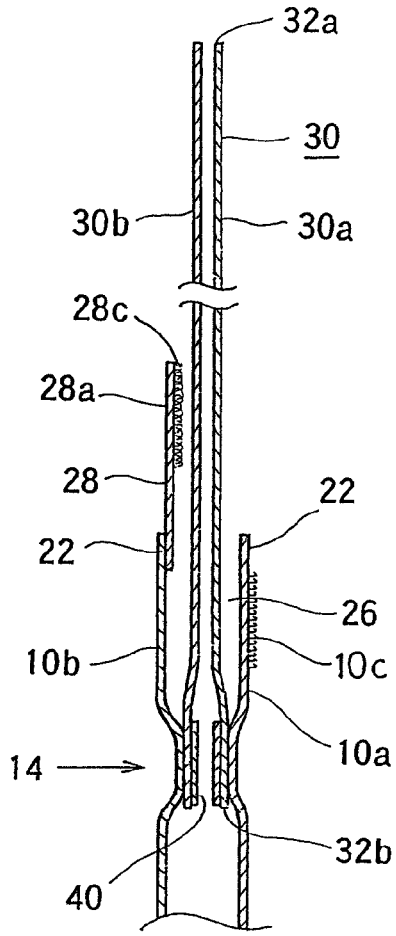
FIG. 6 is a view of an end face taken along a line VI-VI of FIG. 1.
Figure 7:
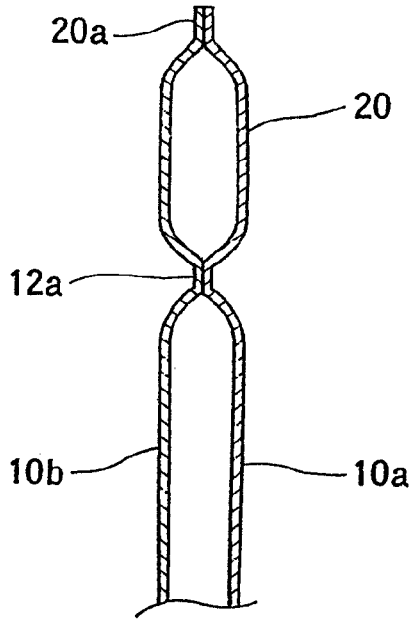
FIG. 7 is a view of an end face taken along a line VII-VII of FIG. 1.
Figure 8:
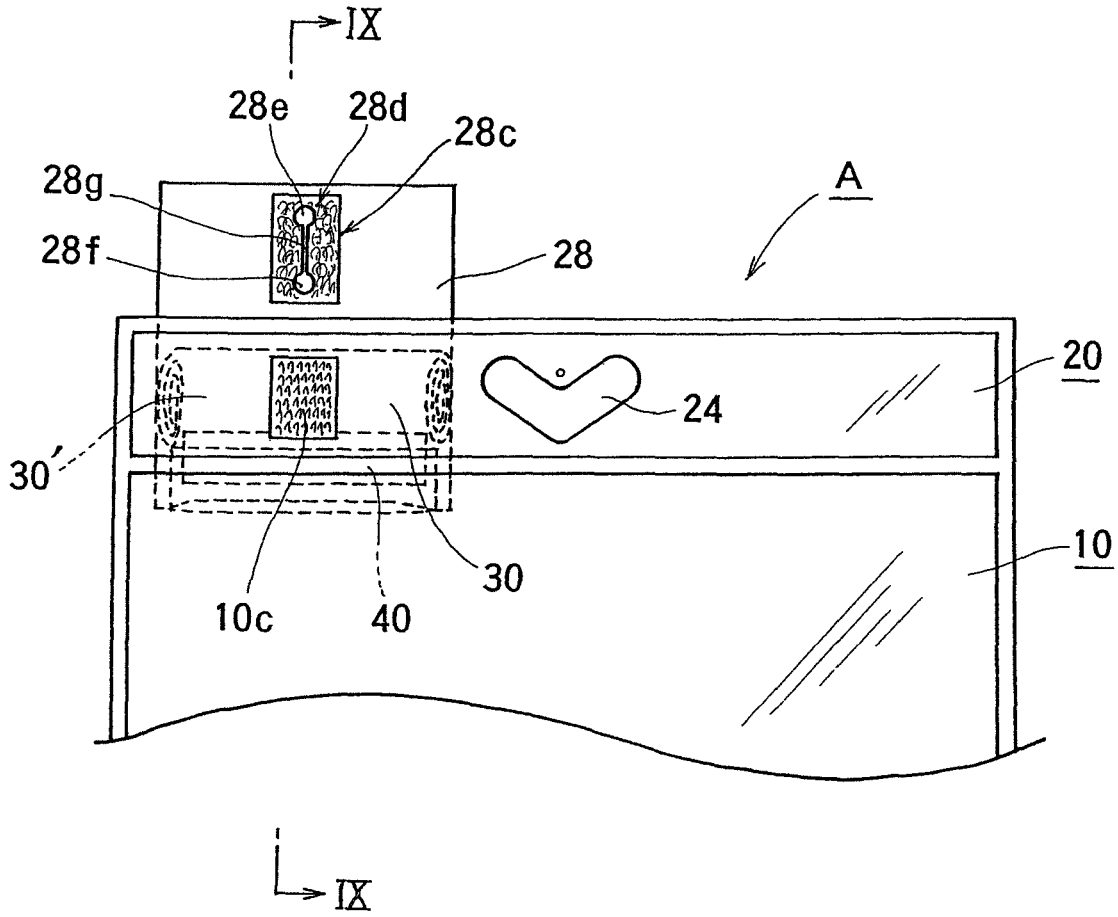
FIG. 8 is a front view omitting the lower half portion showing a state of opening a lid portion of the fluid containing bag of the embodiment according to the invention.
Figure 9:
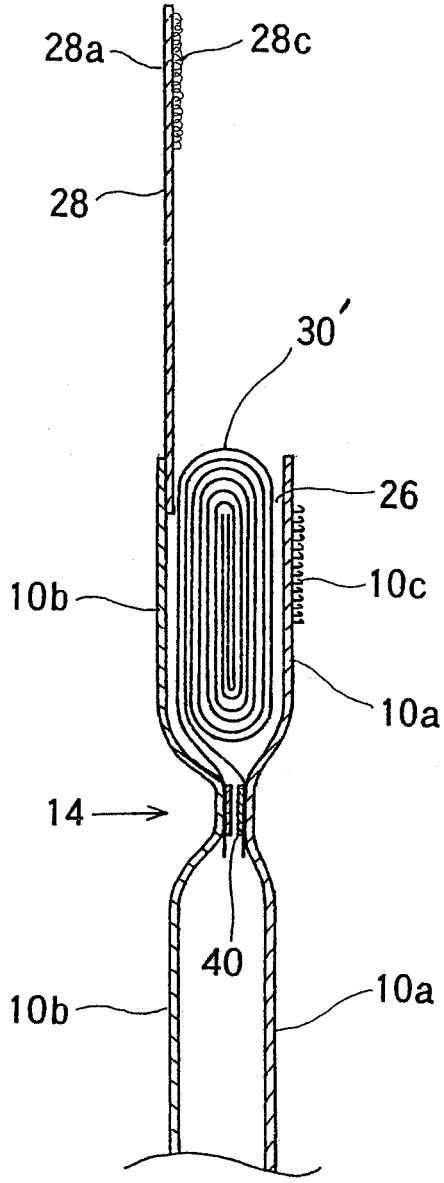
FIG. 9 is a view of an end face taken along a line IX-IX of FIG. 8.
Figure 10:
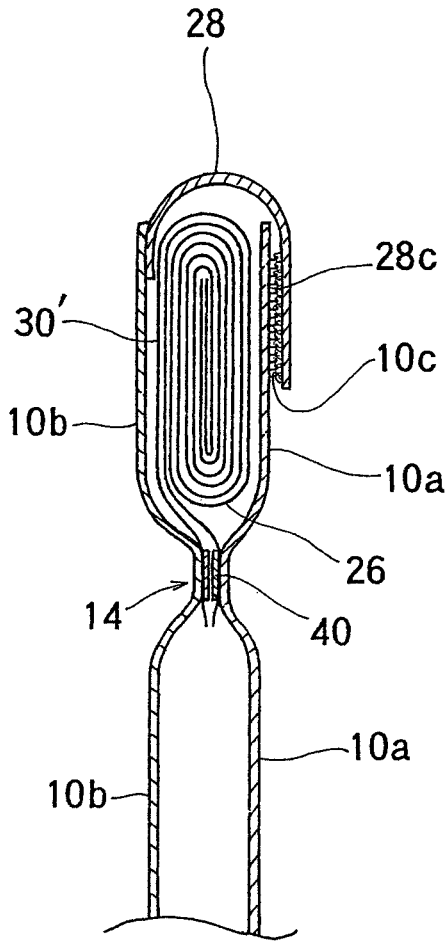
FIG. 10 is a view of an end face omitting the lower half portion showing a state of closing the lid portion of the fluid containing bag of the embodiment according to the invention.
Figure 11:
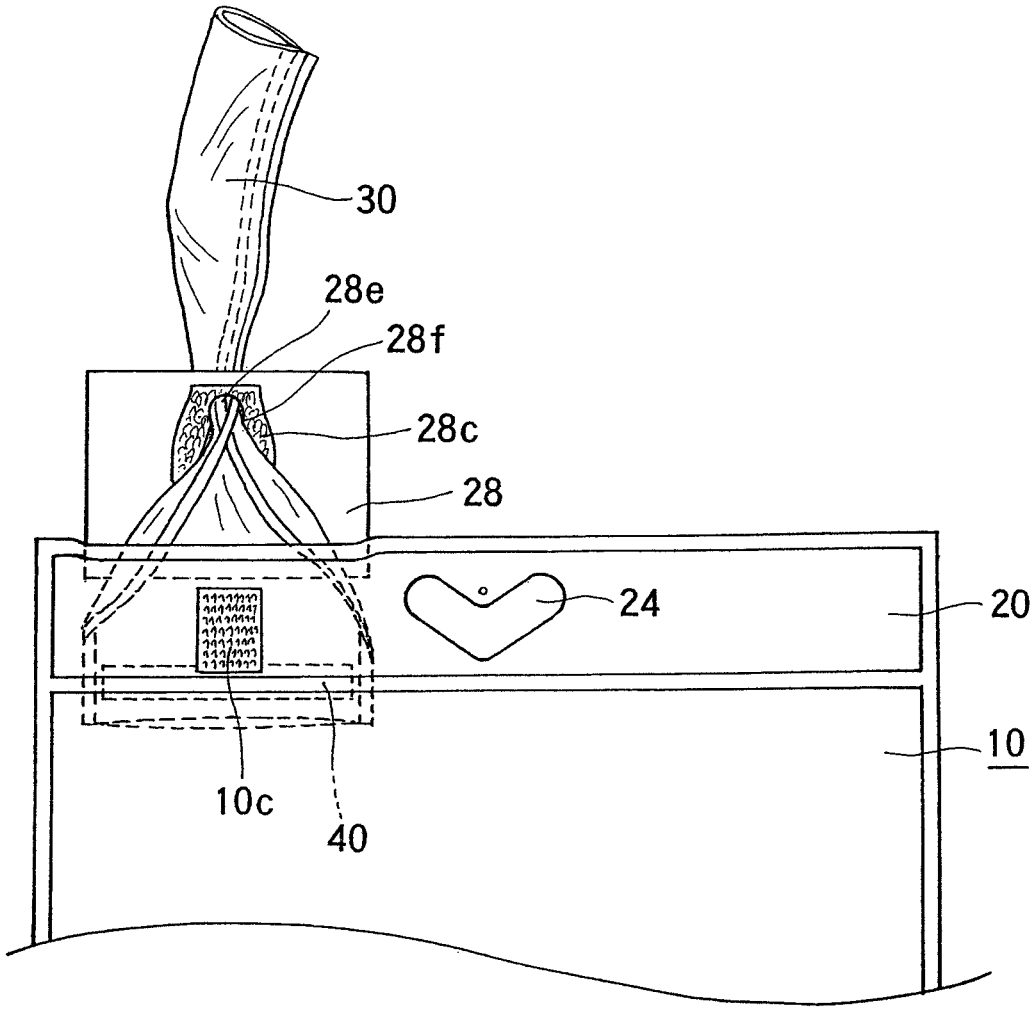
FIG. 11 is a front view omitting the lower half portion showing a state of extending and squeezing the inlet/outlet spout in FIG. 8.
Figure 12:
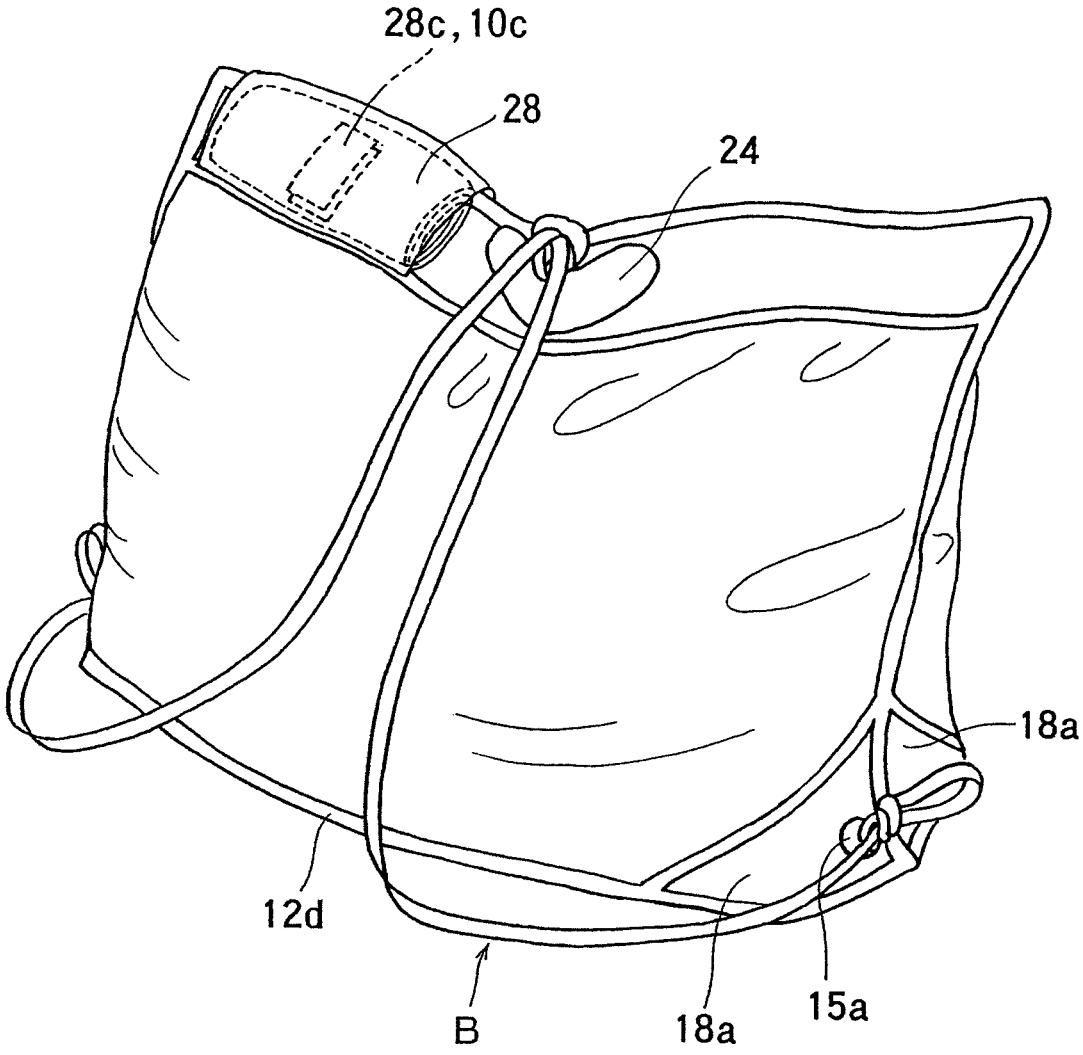
FIG. 12 is a perspective view showing a state of containing water to the fluid containing bag of the embodiment according to the invention to constitute in a shape of a rucksack.
Figure 13:
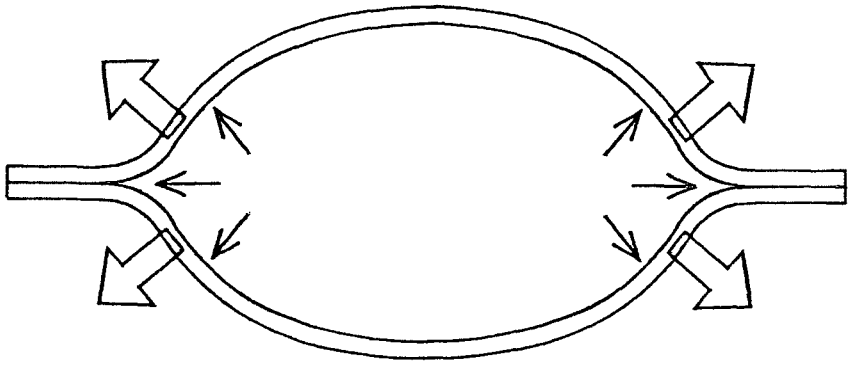
FIG. 13 is a schematic view showing a state of applying a pressure to an inner peripheral face of a base portion of an inlet/outlet spout on a side of being connected to a bag main body according to a background art example.

FIG. 1 is a front view showing an upper half portion of a fluid containing bag of the embodiment. FIG. 2 is a front view showing a lower half portion of the fluid containing bag of the embodiment. FIG. 3 is a view of an end face taken along a line of FIG. 1. FIG. 4 is a schematic view showing a state of applying a pressure to a reinforcing tape attached to an inner peripheral face of a base portion of an inlet/outlet spout on a side of being connected to a bag main body. FIG. 5 is a perspective view showing a state of containing water in the fluid containing bag of the embodiment. FIG. 6 is a view of an end face taken along a line VI-VI of FIG. 1. FIG. 7 is a view of an end face taken along a line VII-VII of FIG. 1. FIG. 8 is a front view omitting the lower half portion showing a state of opening a lid portion of the fluid containing bag of the embodiment. FIG. 9 is a view of an end face taken along a line IX-IX of FIG. 8. FIG. 10 is a view of an end face omitting the lower half portion showing a state of closing the lid portion of the fluid containing bag of the embodiment. FIG. 11 is a front view omitting the lower half portion showing a state of extending and squeezing the inlet/outlet spout in FIG. 8. FIG. 12 is a perspective view showing a state of containing water to the fluid containing bag of the embodiment to constitute a shape of a rucksack.

In FIG. 1 and FIG. 2, notation A designates a fluid containing bag (hereinafter, simply referred to as "bag") of the embodiment, and the bag A is formed by a bag main body 10 and one inlet/outlet spout 30. As shown by the respective drawings, the bag main body 10 is formed by welding front and rear two sheets 10*a*, 10*b* comprising plastic films or the like at four peripheral portions. That is, there are an upper welding portion 12*a*, a left welding portion 12*b*, a right welding portion 12*c*, bottom welding portions 12*d*, 12*e* in welding portions, all of which are welded linearly. Further, the bag main body 10 is defined by a portion below the upper welding portion 12*a*. Further, although at the upper welding portion 12*a*, the front and rear sheets 10*a*, 10*b* are welded, even on a line of the upper welding portion 12*a*, the front and rear sheets 10*a*, 10*b* are not welded at a fluid flowing portion 14 slightly on a left side of a center portion of FIG. 1.

The inlet/outlet spout 30 is constituted by a flat cylindrical member similarly comprising plastic films for both of injecting and discharging a content. A lower end 32*b* thereof is disposed slightly on a lower side of the upper welding portion 12*a*, that is, the fluid flowing portion 14. Front and rear sheets 30*a*, 30*b* constituting the inlet/outlet spout 30 are welded to each other at both side portions 32*c*, 32*d* thereof and an upper end 32*a* and the lower end 32*b* are opened. Further, the inlet/outlet spout 30 is attached to the bag main body 10 as follows. That is, at the fluid flowing portion 14, an outer face of the sheet 30*a* on the near side (front side) of FIG. 1 of the inlet/outlet spout 30 is welded to an inner face of the sheet 10*a* on the near side (front side) constituting the bag main body 10. Further, an outer face of the sheet 30*b* on a back face side (rear side) constituting the inlet/outlet spout 30 is welded to an inner face of the sheet 10*b* on a back face side (rear side) constituting the bag main body 10. In this way, the inlet/outlet spout 30 is welded to fix to the bag main body 10, only at the fluid flowing portion 14 disposed on a lower side of the inlet/outlet spout 30, the bag main body 10 is communicated with outside through the inlet/outlet spout 30 and the bag main body 10 is closed quite hermetically at a remaining portion thereof.

At the inlet/outlet spout 30, as shown by FIG. 3, a reinforcing tape 40 is welded to fix to a base portion on a side of being connected to the bag main body 10 by welding and fixing, that is, an inner peripheral face of the fluid flowing portion 14. Further, the reinforcing tape 40 is welded to fix to bridge the two sheets 30*a*, 30*b* forming the inlet/outlet spout 30 at the welding portions of both side portions 32*c*, 32*d* of the two sheets 30*a*, 30*b* constituting the inlet/outlet spout 30. Further, the reinforcing tape 40 is adhered thereto such that air gaps p are present between the adhering portions of the both side portions 32*c*, 32*d* of the inlet/outlet spout 30 and the reinforcing tape 40. By constituting in this way, the reinforcing tape 40 prevents destruction of the fluid flowing portion 14 of the inlet/outlet spout 30. That is, as shown by FIG. 5 and FIG. 10, in a case in which a fluid is contained in the bag A and the upper end 32*a* of the opened inlet/outlet spout 30 is closed when a strong external force is exerted to the bag by dropping or pressing or the like, as shown by FIG. 4, an inner pressure (indicated by a slender arrow mark) of expanding the inlet/outlet spout 30 is applied to the fluid flowing portion 14 of the inlet/outlet spout 30. However, the inner pressure becomes a force (indicated by a white bold arrow mark) in a direction of extending the reinforcing tape 40, and a strength of the reinforcing tape 40 against the extending force restrains the force in a direction of peeling off the adhering portions of the two sheets 30*a*, 30*b* constituting the inlet/outlet spout 30 by the inner pressure. Further, even when the reinforcing tape 40 is slightly extended, the sheets 30*a*, 30*b* constituting the inlet/outlet spout 30 follow the extension by presence of the air gaps p, and therefore, so far as a force of peeling off the adherence of the both sheets 30*a*, 30*b* is not exerted to the adhering portions of the two sheets 30*a*, 30*b* constituting the inlet/outlet spout 30 by extending the reinforcing tape 40 to be torn off, a situation of breaking the fluid flowing portion 14 of the inlet/outlet spout 30 is not brought about.

Further, although according to the embodiment, the reinforcing tape 40 is attached to a surrounding excluding a portion of the inner peripheral face of the inlet/outlet spout 30, the reinforcing tape 40 may be attached over an entire periphery thereof, further, the reinforcing tape 40 may be attached only to two portions of the adhering portions 32*c*, 32*d* of the two sheets 30*a*, 30*b* constituting the inlet/outlet spout 30 to ride over the both adhering portions 32*c*, 32*d*. Further, although according to the embodiment, the reinforcing tape 40 is a tape having a comparatively slender width, when a tape having a wide width is used, a reinforcing area is increased, and therefore, an effect of promoting a durability is achieved.

Further, there is constructed a constitution of using a melt-press-contacting plastic material, for example, polyethylene of a material the same as that of an inner face side of the inlet/outlet spout 30 on an outer face side constituting the adhering face of the reinforcing tape 40 and laminating a plastic material having a melting point higher than that of the outer face side of the reinforcing tape 40, for example, nylon on an inner face side constituting a nonadhering face of the reinforcing tape 40. When constituted in this way, in forming the upper welding portion 12*a*, thermal welding of the front and rear sheets 10*a*, 10*b* and the inlet/outlet spout 30 and thermal welding of the inlet/outlet spout 30 and the reinforcing tape 40 can simultaneously be carried out, and therefore, an advantage of promoting an operability is achieved.

The front and rear sheets 10*a*, 10*b* form an extended portion 20 by being extended to an upper side from the upper welding portion 12*a*. The front and rear sheets 10*a*, 10*b* are welded at an upper end 20*a* and two left and right portions 20*b*, 20*c* of the extended portion. However, as shown by FIG. 1 and FIG. 6 and FIG. 7 constituting views of end faces thereof, at the welding portion 20*a* of the upper end, the front and rear sheets 10*a*, 10*b* are not welded at a portion 22 on a left side of FIG. 1. The nonwelded portion 22 is disposed at a position of coinciding with the fluid flowing portion 14 of the upper welding portion 12*a* in an axial direction. Further, the inlet/outlet spout 30 of the flat cylindrical member passes through the nonwelded portion 22. According to the embodiment, the front and rear sheets 10*a*, 10*b* and the inlet/outlet spout 30 are not welded at the nonwelded portion 22. Further, numeral 24 designates a hand carrying hole provided at the extended portion and the bag A is made to be able to carry by the hand by inserting the finger into the hand carrying hole 24.

Further, as shown by FIG. 6, a space portion between the sheet 10*a* of the front face side and the inlet/outlet spout 30 forms a pocket portion 26 for containing the inlet/outlet spout 30 in a folded state. At the portion 22 of the sheet 10*b* on the back face side, a lid 28 for closing the pocket portion 26 is welded thereto. After injecting a liquid or the like to inside of the bag main body 10 in a state shown in FIG. 1, as shown by FIG. 8 and FIG. 9, the inlet/outlet spout 30 is folded in the axial direction and is contained at inside of the pocket portion 26. A front end of the lid 28 is provided with a female member 28*c* of a face fastener, and a male member 10*c* is attached to a portion corresponding to the female member 28*c* when the lid 28 is folded back to a side of the bag main body 10. Further, the pocket portion 26 is closed by the lid 28 (FIG. 10) by folding back a free end 28*a* thereof further to a front face side of the front sheet 10*a* on the front face side constituting the bag main body 10 to cover a folded member 30' of the inlet/outlet spout 30 contained in the pocket portion 26, and engaging the female member 28*c* of the face fastener arranged at the free end 28*a* with the male member 10*c* of the face fastener arranged at the front sheet 10*a* on the front face side constituting the bag main body 10. When the pocket portion 26 is closed by the lid 28 in this way, a state of folding the folded member 30' is maintained. Therefore, even when a liquid or the like contained at inside of the bag is going to be leaked to outside, the liquid or the like cannot pass the inlet/outlet spout 30 maintained in a folded state in this way. Further, in FIG. 9 and FIG. 10, for simplicity, the front and rear sheets 30*a*, 30*b* constituting the inlet/outlet spout 30 are respectively designated by single pieces of lines and thicknesses thereof are not designated. Further, although a corner portion of the folded member 30' is indicated by a circular arc shape, actually, the corner portion is bent like a crease and passing of the liquid or the like is shut off by the corner portion of the bent portion. Further, in a state of folding the inlet/outlet spout 30 at inside of the pocket portion 26, when the lid 28 is closed, the male and female members 28*c*, 10*c* constitute means for maintaining a state of closing the lid.

Further, as shown by FIG. 8, the female member 28*c* is formed with an opening 28*d*. The opening 28*d* is constituted by a circular holes 28*e*, 28*f* disposed on upper and lower sides thereof and a linear cut 28*g* for connecting the both. Further, in a state of extending the inlet/outlet spout 30, as shown by FIG. 11, the inlet/outlet spout 30 is inserted into the opening 28*d*. Thereby, the inlet/outlet spout 30 is squeezed by the opening 28*d*. The opening 28*d* is easy to be expanded by providing the circular holes 28*e*, 28*f* on upper and lower sides, and therefore, the inlet/outlet spout 30 is easy to be inserted. Further, by providing the linear cut 28*g* between the two circular holes 28*e*, 28*f*, the inserted inlet/outlet spout 30 is strongly compressed by the portion of the cut 28*g* and an effective squeezed state can be achieved.

Next, a bottom portion 15 of the bag main body 10 will be explained in reference to FIG. 2. The bottom portion 15 is folded in a gusset-like shape. That is, the front and rear sheets 10*a*, 10*b* are folded back to sides of opposed faces thereof at the bottom portion 15. Fold back pieces 16*a*, 17*a* are made to be continuous at a top portion 18. In this way, front and rear two folding portions 16, 17 are formed. Both of the folding portions 16, 17 are formed with welding portions 16*b*, 17*b* in skewed directions, and constituted such that a liquid at inside of the bag is shut off by the welding portions 16*b*, 17*b* and does not reach corner portions 18*a* at the bottom portion. Since such a bottom portion structure is provided, when water or the like is contained at inside thereof, the bottom portion 15 is widened to constitute a mode shown in a perspective view of FIG. 5. Although according to the embodiment, the bag main body 10 which is flat comprising the front and rear two sheets 10*a*, 10*b* and provided with a gusset at the bottom portion 15 is exemplified, the bag main body which is not provided with the gusset at the bottom portion and conversely, a bag main body having a gusset at a side portion of the bag main body are included in the range of the invention.

FIG. 12 shows the bag A of the embodiment constituted in a form that can be carried on the back like a rucksack. That is, openings 15*a* are provided at the corner portions 18*a* on both left and right sides of the bag bottom portion 15, a string B is hung between the hand carrying hole 24 provided at the extended portion 20 and the four openings 15*a* of the bottom portion 15, and the bag A is made to be carried by the string B.

[Example]

The inventors form an invented product shown in the embodiment and a background art product shown in Patent Reference 1 by the following procedure and carry out a comparative test with regard to a strength.

Constitution of invented product: formed by a multilayered film having a thickness of 0.15 mm and a major component of nylon/polyethylene, and having a size of length and of breadth of 340 mm and an inner capacity of about 6 liters, 3 pieces of bags having reinforcing tapes are formed as samples to respectively constitute invented product A, invented product B, invented product C.

Constitution of background art product: formed by a multilayered film having a thickness of 0.15 mm and major component of nylon/polyethylene, having a size of length and breadth of 340 mm and an inner capacity of about 6 liters, 3 pieces thereof which are not provided with reinforcing tapes are formed as samples to respectively constitute background art product A, background art product B, background art product C.

Test Method 6 liters of water is injected into a bag, an inlet/outlet spout is closed by a lid, a bag is placed to lie down on a horizontal base, a compression load is applied at a speed of 50 mm/min by a press plate covering a total of a top face of the lying bag and a maximum load value by which the bag reaches destruction is measured. A measurement result thereof is shown in Table 1.

TABLE 1

| sample | maximum load value (Kgf) | sample | maximum load value (Kgf) | strength increase rate relative to maximum value 168 Kgf of maximum load value of background art product |
|---|---|---|---|---|
| background art product A | 158 | invented product A | 380 | 2.26 times |
| background art product B | 163 | invented product B | 337 | 2.01 times |
| background art poroduct C | 168 | invented product C | 296 | 1.76 times |

Test Result

In the above-described measurement, all of the bags are destructed at a portion of the base portion of the inlet/outlet spout on the side of being connected to the bag main body of the bag constituting the problem of the invention. Further, from the above-described measurement result, it is found that there is a sufficient strength capable of withstanding a load twice as much as or more a physical weight of a person even in the background art products. Further, even when a maximum value of a maximum load value of the background art product and a minimum value of a maximum load value of the invented product are compared, a minimum value of the maximum load value of the invented product is 1.76 times as much as the maximum value of the maximum load value of the background art product, and it is found that the strength of the invented product is remarkably increased.

The invention claimed is:

1. A fluid containing bag comprising a bag main body which includes front and rear two sheets and an entire periphery of which is hermetically sealed except one portion, an inlet/outlet spout a proximal end of which is connected to the one portion and a distal end of which is spaced from the proximal end and extends to outside of the bag main body, and a reinforcing tape permanently attached to a substantially entire periphery or an entire periphery of an inner peripheral face only of a base portion of the inlet/outlet spout so as to be immovably joined to said inner peripheral face, the base portion of the inlet/outlet spout being proximate the proximal end of the inlet/outlet spout and spaced from the distal end of the inlet/outlet spout, the inlet/outlet spout being formed by two spout sheets which are adhered at both side portions thereof, and the reinforcing tape being attached to bridge, only at the base portion of the inlet/outlet spout, at least the two spout sheets forming the inlet/outlet spout at both side adhering portions of the inlet/outlet spout.

2. A fluid containing bag comprising a bag main body which includes front and rear two sheets and an entire periphery of which is hermetically sealed except one portion, an inlet/outlet spout a proximal end of which is connected to the one portion and a distal end of which is spaced from the proximal end and extends to outside the bag main body, and a reinforcing tape attached to an inner peripheral face only of a base portion of the inlet/outlet spout, the base portion of the inlet/outlet spout being proximate the proximal end of the inlet/outlet spout and spaced from the distal end of the inlet/outlet spout, the inlet/outlet spout being formed by two spout sheets which are adhered at both side portions thereof, and the reinforcing tape being attached to bridge, only at the base portion of the inlet/outlet spout, at least the two spout sheets forming the inlet/outlet spout at both side adhering portions of the inlet/outlet spout, an inner face of the inlet/outlet spout and an outer face comprising an adhering face of the reinforcing tape each comprise the same thermally-welded plastic material, and an inner face of the reinforcing tape which comprises a non-adhering face thereof comprises a plastic material having a melting point that is higher than a melting point of said outer face of the reinforcing tape.

3. The fluid containing bag according to claim 2, wherein the inner face of the inlet/outlet spout and the outer face comprising an adhering face of the reinforcing tape comprise polyethylene.

4. The fluid containing bag according to claim 2, wherein the inner face comprising a nonadhering face of the reinforcing tape comprises nylon.

* * * * *